United States Patent [19]

Prasnik, deceased et al.

[11] Patent Number: 4,771,693

[45] Date of Patent: Sep. 20, 1988

[54] DETONATOR WITH INSTANT-TRIGGER PRIMER ELEMENT

[76] Inventors: Gottfried Prasnik, deceased, late of Troisdorf; by Regina Prasnik, heir, Schillerstr. 37; Peter-Josef Grommes, Rheindorfer Str. 26, both of 5210 Troisdorf; Gunter Kuhlbach, Auf dem Feldchen 9, 5216 Niederkassel, all of Fed. Rep. of Germany

[21] Appl. No.: 22,961

[22] Filed: Mar. 6, 1987

[30] Foreign Application Priority Data

Mar. 6, 1986 [DE] Fed. Rep. of Germany ..... 3607350

[51] Int. Cl.[4] ..... F42C 19/10

[52] U.S. Cl. ..... 102/204

[58] Field of Search ..... 102/200, 202, 204, 205

[56] References Cited

U.S. PATENT DOCUMENTS 3,195,463 7/1965 Foote et al. ..... 102/204

4,527,481 7/1985 Evans et al. ..... 102/204

FOREIGN PATENT DOCUMENTS 310157 1/1918 Fed. Rep. of Germany ..... 102/204

6909 of 1886 United Kingdom ..... 102/204

*Primary Examiner*—Ted L. Parr

*Attorney, Agent, or Firm*—Antonelli, Terry and Wands

[57] ABSTRACT

A novel detonator is equipped with an instant-trigger primer element. The detonator can be triggered mechanically and provides rapid ignition of the delay charge. In this manner, misfires are avoided which occur due to the fact that in case of an only slight impact, a spring-loaded firing pin is again pulled out of the detonator even before igniting the delay charge and can render the detonator useless because of pressure relief. The primer element contained in the detonator exhibits an outer casing into which is embedded, in a shape-mating fashion, an inner casing so that the bottoms of both casing are placed in mutual superposition in such a way that a cavity is formed between them, this cavity being furthermore defined by the sidewall of the outer casing. This cavity houses the primer charge which is to contain, besides the usual oxidants and reducing agents, rapidly acting initiating explosives. A directional ignition jet is produced by a special configuration of an ignition duct.

12 Claims, 1 Drawing Sheet

DETONATOR WITH INSTANT-TRIGGER PRIMER ELEMENT

The present invention relates to a detonator with an instant-release primer element. The primer elemen is sensitive to puncture, or respeotively, to impact and acts on a delay charge which, in turn, after having been reacted, initiates a subsequently arranged igniter composition.

In conventional detonators, the primer element is fashioned as a primer cap, housing an impact-sensitive primer charge in a one-piece cup; after ignition of the primer charge, the ignition gases and, respectively, the flame pass via one or several ignition ducts to the delay charge and ignite the delay charge.

One disadvantage in detonators with these primer elements is the circumstance that ignition of the primer charge generally takes place by means of a spring-loaded firing pin which, though highly sensitive to impact, will frequently be torn out again from the detonator by the action of spring force even before the deflagration time of the delay charge has elapsed. This process causes a pressure relief and can lead to extinction of the deflagration process in the delay charge so that misfires occur. These effects are observed, in particular, when hitting an only minor obstacle, such as, for example, shrubbery or branches; whereas such effects take place hardly even upon a strong impact of the detonator, for example when impacting on hard ground.

Therefore, an object of the present invention is to develop detonators which also provide flawless detonation when impacting on a slight obstacle even if the firing pin, due to the spring force acting thereon, is torn out of the detonator again before complete deflagration of the delay charge has taken place.

In attainment of this object, a mechanically by spring released firing pins releasable primer element arranged in a detonator has now been found for the ignition of a delay charge which is accommodated in a detonator casing together with subsequently arranged initiating composition and secondary charge, this primer element being characterized by an outer casing, an inner casing arranged coaxially within the outer casing so that a cavity remains between the bottom wall of the outer casing and the bottom wall of the inner casing, the sidewalls of the cavity being defined by the sidewalls of the outer casing and the cavity being filled with a primer charge of quickly reacting initiator explosive.

In this arrangement according to the invention, a directional ignition duct is provided which directs the ignition jet in a concentrated or focused fashion onto the delay charge, ignites the delay charge with extreme speed and reliability, and renders ignition and deflagration of the charge independent of any possible premature pressure relief due to a retracting firing pin.

The outer casing surrounding the primer element is relatively thick-walled and has a thin bottom wall; the wall thickness of the bottom wall can be between 0.05 and 0.15 mm. The sidewalls can increase in thickness toward the bottom wall; this increase is such that the outer diameter of the casing remains constant; whereas the inner diameter becomes ever smaller toward the bottom so that the radius of the thin bottom part becomes correspondingly smaller. The wall thickness at the bottom of the casing can here assume the same dimension as that at the radius of the thin bottom part.

The inner casing has an outer diameter corresponding to the inner diameter of the outer casing. The outer side wall surface of the inner casing is in shape-mating, firm contact with the inner wall surface of the outer casing. The inner casing is arranged coaxially within the outer casing so that its bottom forms a cavity with the bottom of the outer casing and the sidewall or sidewalls of the outer casing, the primer charge being arranged in this cavity.

The walls of the inner casing are thinner than the walls of the outer casing. The thickness of the bottom wall corresponds approximately to the thickness of the bottom wall of the outer casing. The wall thickness of the sidewalls is somewhat larger than that of the bottom wall, generally between 0.15 and 0.55 mm.

In the inner casing as well as in the outer casing, the open side or portion lying oppositely to the bottom wall can be curved inwardly so that this casing side, which in the following description is also designated as a casing orifice, has the shape of a disk with a circular opening. In a preferred embodiment of the invention, the side of the inner casing, bent in this way, is in direct, shape-mating contact with the correspondingly bent side of the outer casing.

In general, the diameter of the casing orifice of the outer casing corresponds to the diameter of the casing orifice of the inner casing. Preferably, in both casings the inner diameter is smaller than the height of the corresponding casing. The orifice of the inner casing preferably adjoins that of the outer casing.

Suitable as a material for the inner and outer casings are metals, metal alloys, or synthetic resins. Preferred materials are aluminum or brass.

The cavity defined by the wall of the outer casing and the bottom walls of the inner and outer casings contains a conventional primer charge of oxidants and reducing agents, as well as quick-acting initiating or initiator explosives. The proportion of initiating explosives in this primer charge generally ranges between 40 and 60% by weight, depending on the desired trigger sensitivity. The entire charge can be utilized in loose form as well as bound by conventional binders for fixing the components.

Examples for usable initiating explosives are lead azide, diazodinitrophenol, lead trinitroresorcinate, tetrazene, or azotetrazole in the form of its heavy metal salts.

The entire primer element is arranged within the detonator so that the casing orifice points in the direction of the delay charge. The delay charge is arranged within the detonator casing coaxially to this casing.

The invention will be described by way of example with reference to the accompanying drawings wherein.

Figure 1:
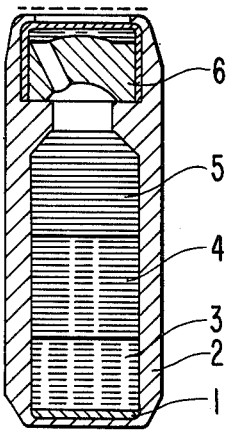
FIG. 1 (PRIOR ART)
FIG. 1 shows a sectional view of a detonator in accordance with the state of the art.
Figure 2:
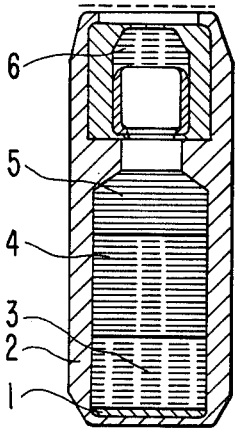
FIG. 2 shows a sectional view of the detonator according to this invention with a primer element.

In the figures, reference numeral 2 denotes a tubular detonator casing wherein there are arranged, in series, the primer element 6—fashioned as a primer cap in FIG. 1—the delay charge 5, the initiating charge 4, and the secondary charge 3. The secondary charge 3 is preferably covered by an end disk 1.

Figure 3:
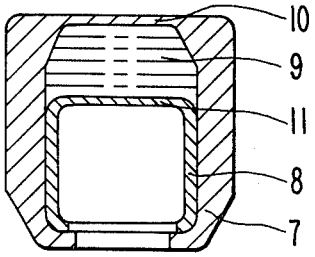
FIG. 3 shows the primer element in an enlarged representation, all of the views being longitudinal sections.

In FIG. 3, the outer casing is denoted by reference numeral 7 and the inner casing by 8. The primer charge 9 is located between the outer casing and the inner casing. The cavity wherein this primer charge is disposed is enclosed by the bottom wall 10 of the outer casing 7 and the bottom wall 11 of the inner casing 8, as well as by the sidewalls or a cylindrical sidewall of the outer casing 7.

What is claimed is:

1. In a detonator with a primer element, mechanically triggerable by a firing pin which punctures the element, a delay charge ignitable by the primer elements and with a subsequently arranged initiating charge and a secondary charge, which are arranged in a common detonator casing, the improvement wherein said primer element comprises at least one outer casing and one inner casing coaxially positioned within the outer casing in a shape-mating fashion along sidewalls of the casings and arranged so that a cavity remains between a bottom wall of the outer casing and a bottom wall of the inner casing, sidewalls of said cavity being defined by at least one sidewall of the outer casing, and said cavity being filled with a primer charge comprising a quickly reacting initiating explosive.

2. A detonator according to claim 1, wherein a sidewall of the outer casing of the primer element is thicker than the bottom wall of said outer casing.

3. A detonator according to claim 2, wherein the wall thickness of the at least one sidewall of the outer casing of the primer element increases in direction of the bottom wall towards the interior of the outer casing.

4. A detonator according to claim 1, wherein the wall thickness of the at least one sidewall of the outer casing of the primer element increases in the direction of the bottom wall towards the interior of the outer casing.

5. A detonator according to claim 1, wherein the outer casing and the inner casing each have a cylindrical sidewall and the length of the outer casing is larger than an outer diameter of the outer casing.

6. A detonator according to claim 5, wherein an open side of the outer casing of the primer element is bent inwards so that an end in opposition to the bottom wall of the casing has the shape of a disk with a circular opening.

7. A detonator according to claim 1, wherein an open end of the inner casing directly adjoins an open end of the outer casing.

8. A detonator according the claim 1, wherein the detonator comprises an instant-trigger primer charge.

9. A detonator according to claim 8, wherein the outer casing and the inner casing each have a cylindrical sidewall and an ignition duct between the primer charge and the delay charge is larger than a diameter of an opening of the primer element.

10. A detonator according to claim 1, wherein said inner casing defines a cavity that is spaced from the cavity filled with the primer charge and that has an opening directly adjoining an opening defined by the outer casing.

11. A detonator equipped with a primer element triggerable by a firing pin by puncturing the element; said primer element consisting of an outer casing and an inner casing arranged coaxially within the outer casing in a shape-mating fashion along sidewalls of each casing and arranged to define a cavity between a bottom wall of the outer casing an a bottom wall of the inner casing, sidewalls of said cavity being defined by at least one sidewall of the outer casing, and said cavity being filled with a primer charge comprising a quickly reacting initiating explosive.

12. A detonator according to claim 11, wherein said inner casing defines a cavity that is spaced from the cavity filled with the primer charge and that has an opening directly adjoining an opening defined by the outer casing.

* * * * *